US008167184B2

(12) United States Patent
Kuechler et al.

(10) Patent No.: US 8,167,184 B2
(45) Date of Patent: May 1, 2012

(54) MAGAZINE FOR USE WITH A NAIL DRIVING TOOL

(75) Inventors: Gerhard Kuechler, Hamburg (DE); Jacob Lemsom, Castricum (NL)

(73) Assignee: Paslode Duo-Fast Industry Benelux BV, Venlo (NL)

( * ) Notice: Subject to any disclaimer, the term of this patent is extended or adjusted under 35 U.S.C. 154(b) by 130 days.

(21) Appl. No.: 12/670,401

(22) PCT Filed: Jul. 23, 2008

(86) PCT No.: PCT/IB2008/001915

§ 371 (c)(1), (2), (4) Date: Jan. 24, 2010

(87) PCT Pub. No.: WO2009/013602

PCT Pub. Date: Jan. 29, 2009

(65) Prior Publication Data

US 2010/0206935 A1 Aug. 19, 2010

(30) Foreign Application Priority Data

Jul. 25, 2007 (EP) ..... 07290935

(51) Int. Cl.
*B25C 1/16* (2006.01)

(52) U.S. Cl. ..... 227/120; 227/109

(58) Field of Classification Search ..... 227/109, 227/120, 136, 156, 119
See application file for complete search history.

(56) References Cited

U.S. PATENT DOCUMENTS 2,161,973 A 6/1939 Paxton
2,938,213 A * 5/1960 Gorn ..... 227/113
3,007,171 A 11/1961 Critchley
3,266,698 A * 8/1966 Dickson ..... 227/120
3,437,249 A * 4/1969 Baum ..... 227/120
3,504,840 A * 4/1970 Wandel et al. ..... 227/130
4,136,810 A * 1/1979 Bull ..... 227/120
4,480,382 A 11/1984 Haigh et al.
4,728,021 A 3/1988 Kennedy (Continued)

FOREIGN PATENT DOCUMENTS

CN 2225847 Y 5/1996

(Continued)

OTHER PUBLICATIONS

Russian Office Action for 2010106620/21 mailed Mar. 1, 2011.
ISR and WO for PCT/IB2008/001915 mailed Nov. 17, 2008.
EP Search Report for EP07290935 mailed Jan. 22, 2008.
Decision to Grant for Russian 2010106620 mailed Jun. 27, 2011.

*Primary Examiner* — Thanh K. Truong
*Assistant Examiner* — Nathaniel Chukwurah
(74) *Attorney, Agent, or Firm* — Lowe Hauptman Ham & Berner LLP

(57) ABSTRACT

A magazine includes a storage for receiving and storing a plurality of strips of nails, and a driving device for driving the strips along a feeding plane towards an outlet end for feeding the tool with the nails. The storage stores the nail strips in a side-by-side relationship relative to one another. Each nail strip is stacked in a plane roughly perpendicular to the feeding plane. The magazine further has a transporting device for taking one nail strip out of the plurality of stored nail strips and moving it to a pivoting station where the one nail strip is to be pivoted into the feeding plane. The driving device is arranged for driving the pivoted nail strip from the pivoting station towards the outlet end.

20 Claims, 10 Drawing Sheets

U.S. PATENT DOCUMENTS

| | | | | |
|---|---|---|---|---|
| 5,626,274 | A * | 5/1997 | Shkolnikov et al. | 227/109 |
| 6,299,046 | B1 * | 10/2001 | Chen | 227/109 |
| 2005/0242152 | A1 | 11/2005 | Ronconi | |
| 2007/0251969 | A1 * | 11/2007 | Weinmann | 227/120 |

FOREIGN PATENT DOCUMENTS

| | | | |
|---|---|---|---|
| GB | 1008515 | | 10/1965 |
| GB | 2032326 | A | 5/1980 |
| SU | 1315310 | A1 | 6/1987 |
| SU | 1539056 | A1 | 1/1990 |

* cited by examiner

MAGAZINE FOR USE WITH A NAIL DRIVING TOOL

RELATED APPLICATIONS

The present application is national phase of PCT/IB2008/001915 filed Jul. 23, 2008, and claims priority from European Application Number 07290935.1 filed Jul. 25, 2007, the disclosures of which are hereby incorporated by reference herein in their entirety.

BACKGROUND

The invention relates to nail driving tools that make use of nails organized in strips laid flat one on another in a feeding magazine. Such nail driving tools drive nails through a nose, or nail guide, by means of a piston that is driven by pneumatic energy or by combustion energy from propulsive charges, or from a mixture of air and gas from a gas cartridge. In a strip, the nails are placed beside one another, being offset longitudinally along their shanks by one head and being held in position by an adhesive film. Magazines include mechanisms for pushing the strips of nails towards the nose of the tools and for introducing the nails one by one towards the nose of the tools.

These nail driving tools can be used for manufacturing partitions and other wall panels, first for nailing together the various elements of a frame and then for nailing the multiple boards for each of these panels to the frame. It will be understood that such manufacturing is advantageously automated, a nail driving tool then forming part of manufacturing chain in which it is controlled automatically.

It will also be understood that automatic manufacturing involves high firing rates and that these rates require magazines of large capacity.

Nail driving tools have already been used with a magazine suitable for receiving reels of nails supporting 1200 or even 2500 nails. That is much more than magazines can contain when they hold strips of nails. Nevertheless, it is still not sufficient and reloading the tools remains a constraint for operators.

For staplers, which can be used in the same applications, the problem has already been solved so that they can be fed with strips of staples at any moment during their operating cycle. However, with staples, the problem was simple. With nails the problem was simple, and the invention of the present application seeks to solve the problem of continuously feeding nail driving tools with strips of nails, i.e. feeding the tools without stopping their operation.

SUMMARY

To this end, the invention provides a magazine for use with a nail-driving tool, comprising:

storing means for receiving and storing a plurality of strips of nails, each comprising a plurality of collated nails, and each nail having a head and a shank; and means arranged for driving said strips along a feeding plane towards an outlet end for feeding the tool with said nails;

said magazine being characterized in that said storing means are arranged to store the nail strips in a side-by-side relationship relative to one another, stacked in a position roughly perpendicular to said feeding plane;

the magazine further comprising transport means for taking one nail strip out of said plurality of stored nail strips and moving it to.

a pivoting station arranged for pivoting said one nail strip to be pivoted into said feeding plane;

said driving means being arranged for driving the pivoted nail strip from said pivoting station towards said outlet end.

Preferably, the pivoting station comprises an edge for retaining the heads of the nails of the nail strip to be pivoted and two guiding walls for guiding the nails of the pivoted nail strip, one of the guiding walls being movable for enabling the nails to pivot under gravity about said edge.

In the preferred embodiment of the magazine of the invention, said transport means comprise a movable platform arranged for extracting the one of the stacked nail strips lying underneath in the storing means.

Advantageously, the extracting transport platform is driven by a jack.

The storing means may include a rear vertical positioning rib for the stacked nail strips, when they are alternately in opposite directions, whereas the nails of each strip are inclined on the strip.

In this case, the pivoting station better comprises two opposite edges for retaining the heads of the nails of two successive nail strips to be pivoted, respectively.

BRIEF DESCRIPTION OF THE DRAWINGS

The invention should be better understood upon reading the following description of preferred embodiments, with reference to the accompanying drawing, in which.

DETAILED DESCRIPTION

The nail driving tool described below is an automatically-actuated nail driving tool operating on pneumatic energy.

It should be observed at this point that the invention applies equally well to non-automatic nail driving guns that are actuated manually, and also to nail driving tools that operate on other kinds of energy.

Figure 1:
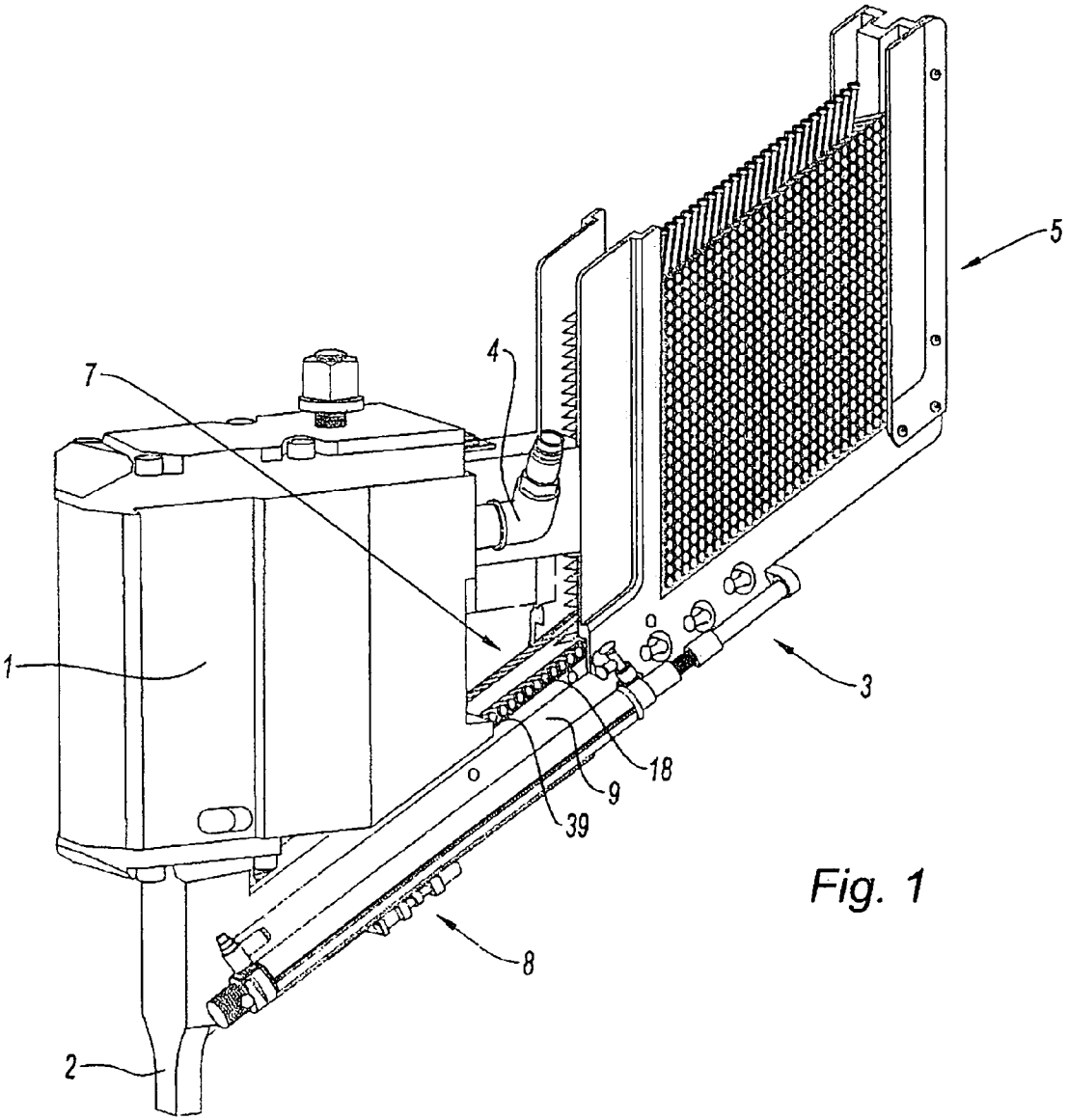
FIG. 1 is a perspective view of a nail driving tool including the first embodiment of the magazine of the invention, full of nail strips.

With reference to FIG. 1, the nail driving tool comprises a casing 1, with a nose 2 and a magazine 3. In conventional manner, the casing includes a cylinder and a piston for propelling nails after they have been inserted into the nose 2, the cylinder and the piston being driven by pneumatic energy taken from an air feeding pipe 4 secured to the casing.

Shots, causing the cylinder and the piston to move, are triggered automatically by computer, and it is in this sense that the nail driving tool is said to be automatic.

The magazine 3 comprises a storing rack 5, a transport carriage 6, a pivoting station 7, and a pushing device 8.

Figure 2:
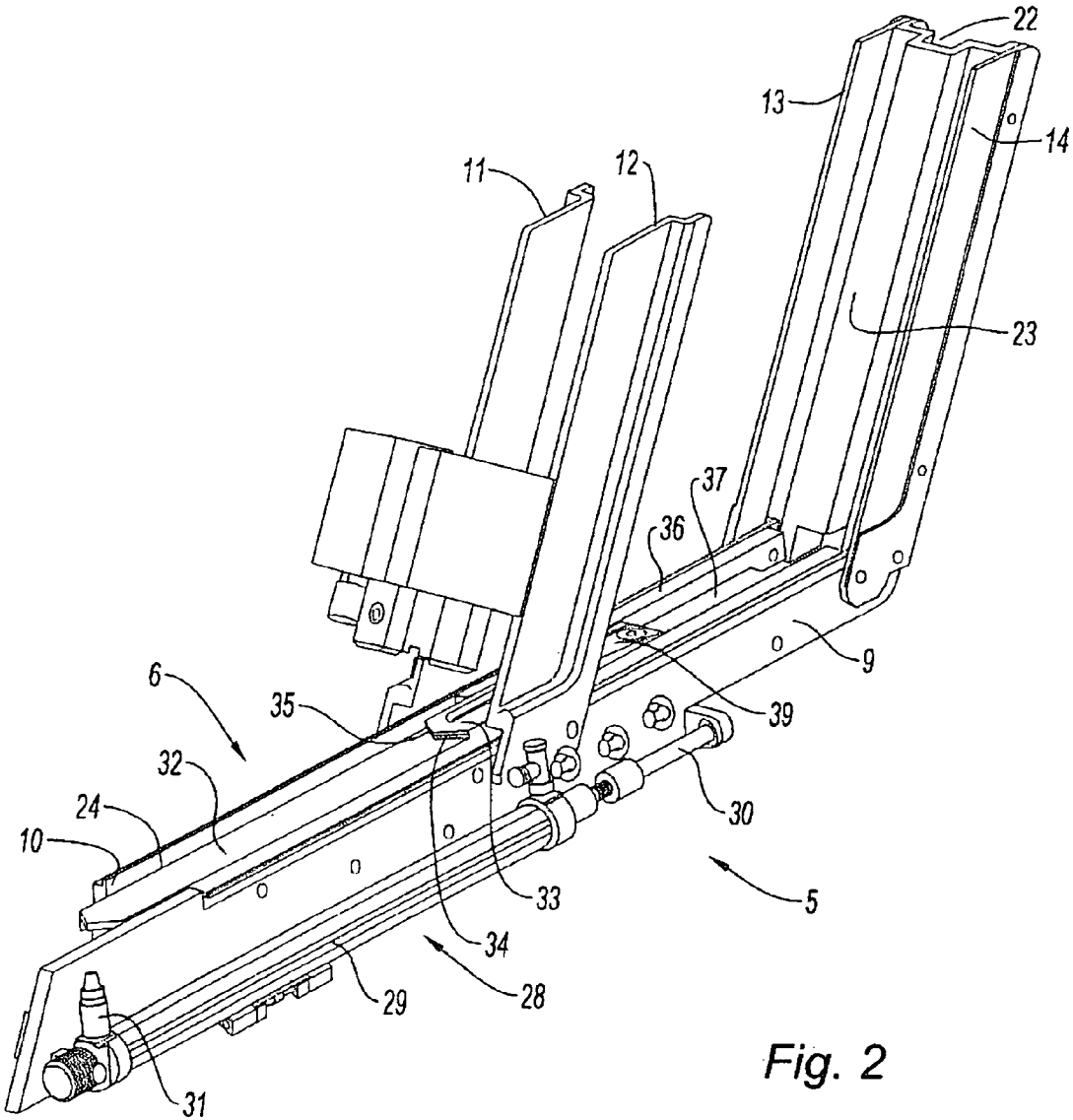
FIG. 2 is a perspective view of the magazine of the tool of FIG. 1, but empty.

With reference to FIGS. 1 and 2, the storing rack 5 in this example has two parallel cross bars 9, 10 fastened to the casing and to the nose of the tool, and serving to guide the transport carriage 6, on which with four uprights 11, 12, and 13, 14 are secured for retaining the strips of nails.

Figure 7:
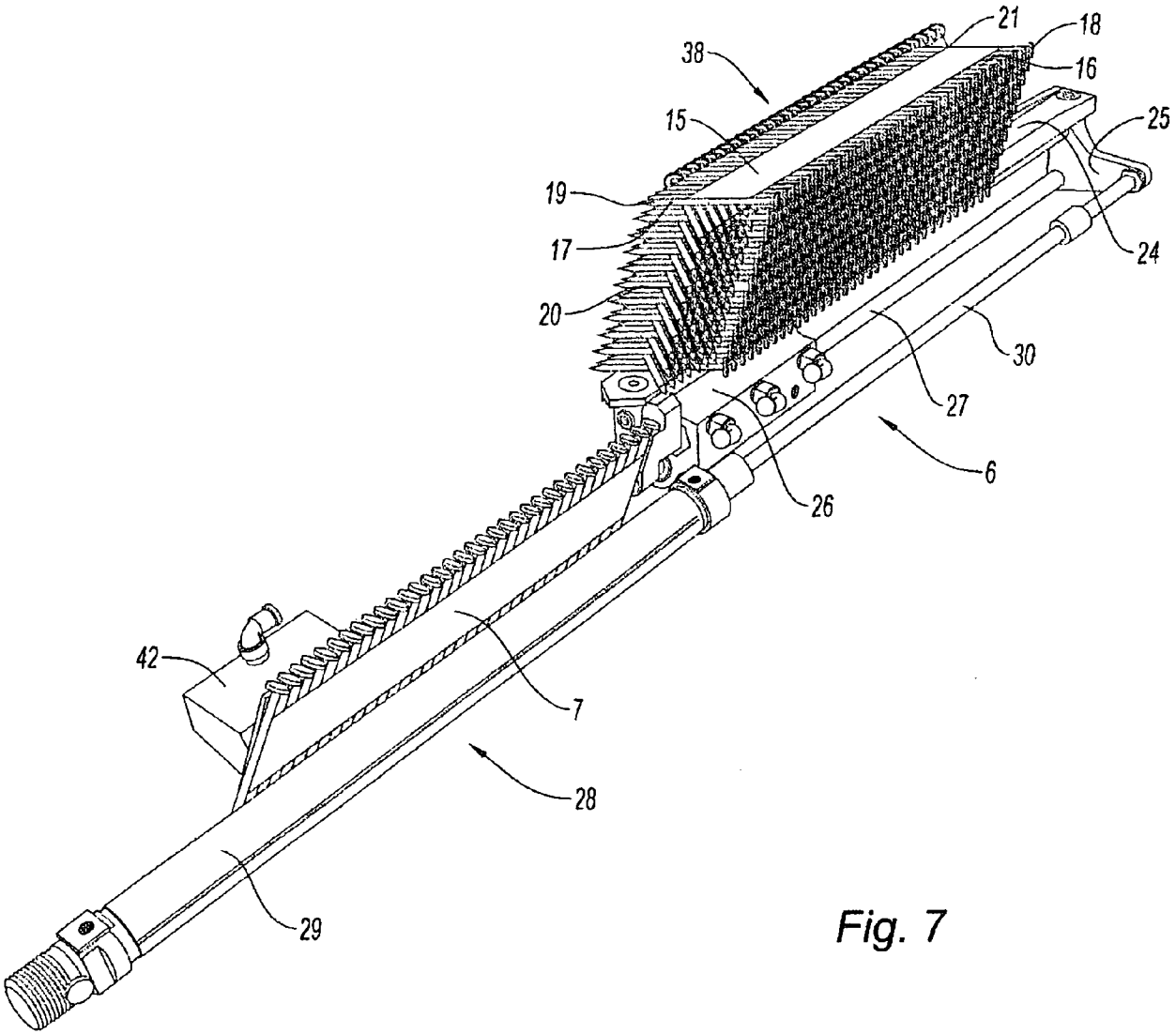
FIG. 7 is a perspective view similar to that of tool including the second embodiment of the magazine of the invention, with a separating pushing tablet.
Figure 8:
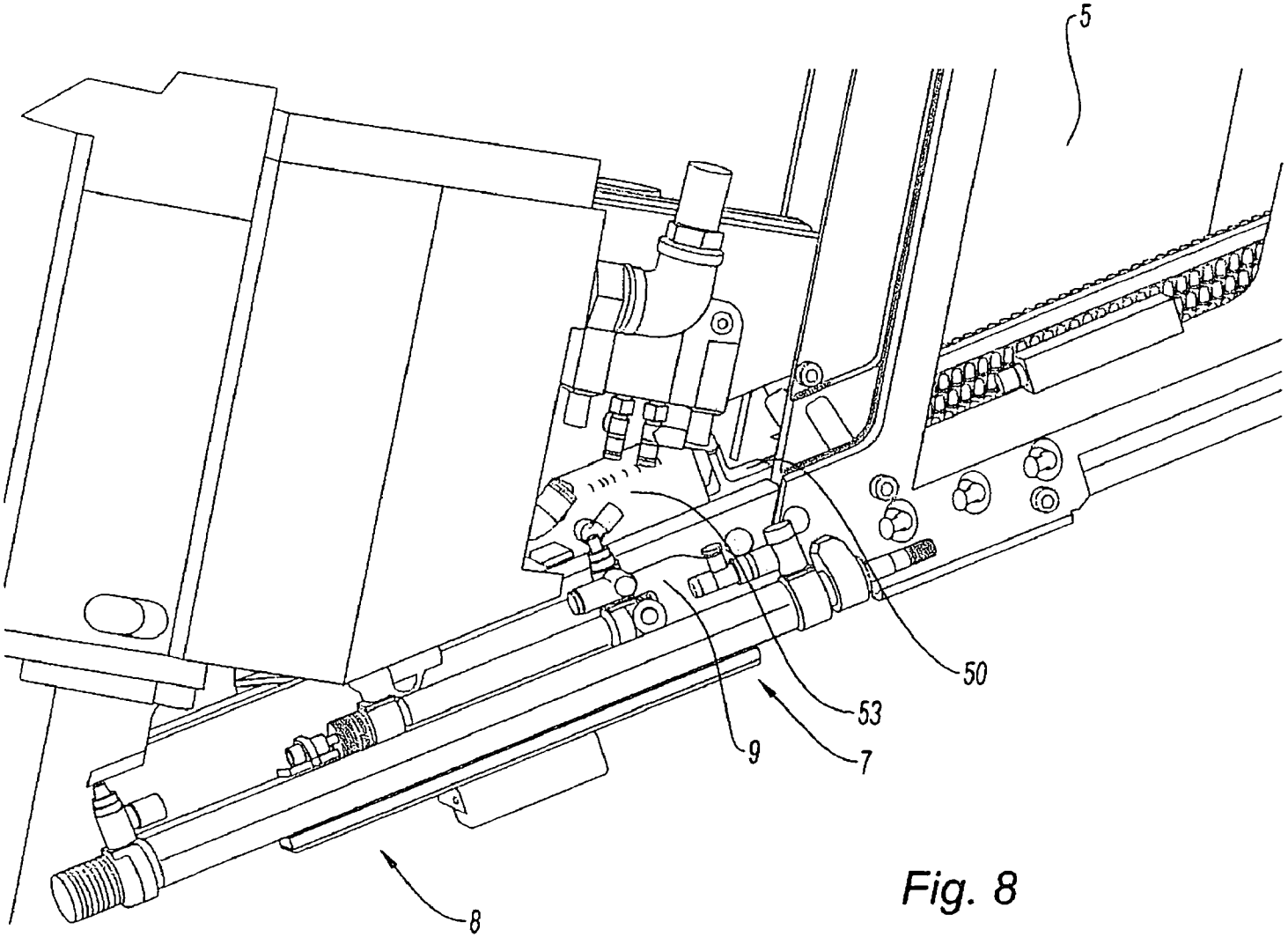
FIG. 8 is a perspective view of a nail driving tool including the second embodiment of the magazine of the invention, with a separating pushing tablet.
Figure 9:
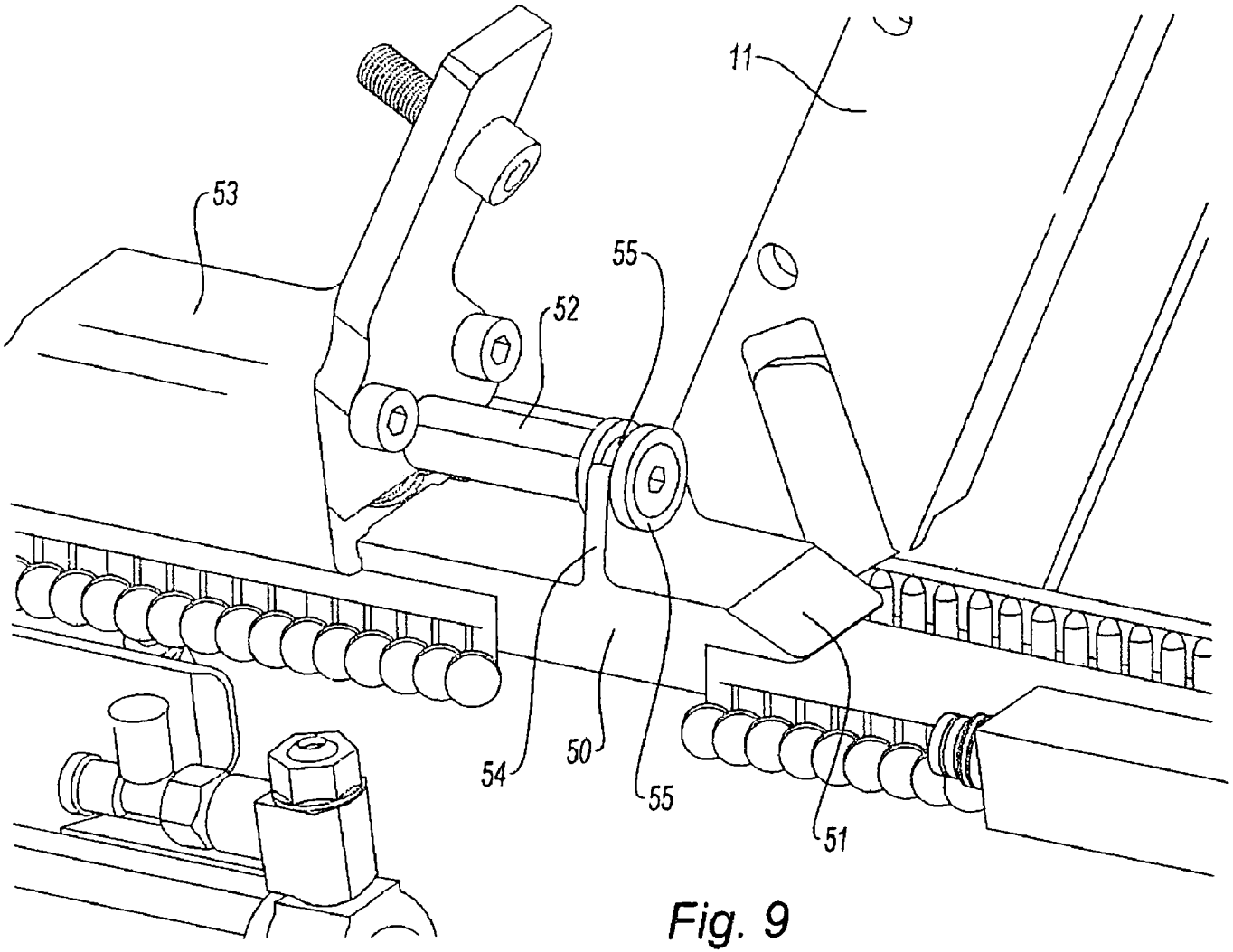
FIG. 9 is a perspective view of the separating pushing tablet of the magazine of the tool of FIG. 8.

The nails 16 are collated on a strip of adhesive film 15 (FIG. 7), of elongate rectangular shape, the nails being inclined relative to the perpendicular to the long sides of the strip, i.e. the nails are not disposed parallel to the short sides of the strip, and they are offset a little relative to one another along their shanks 17 by the thickness of a head, the head 18 of a nail being situated beneath the head of the adjacent nail and against the shank 17 of said adjacent nail. Since the heads of the nails are wider than their shanks, in order to save space, a plurality of strips of nails 15 are stacked one on another with their heads 18 alternately on one side and on the other, each row of heads 18 lying between two rows of points 19 (FIG. 7). Under such conditions, when the stack of strips of nails 15 stored in the rack 5 is viewed from above, the nails of two adjacent (successive) strips of nails are seen to be inclined in opposite directions, crossing each other, so as to form two dihedrals 20, 21 between their shanks 17, along the two short sides of the strips. To ensure that the strips of nails 15 are indeed stored in the rack 5 in this disposition, the rack 5, in its posterior portion, between its two posterior uprights 13, 14 (FIG. 2), includes a profile 22 with a vertical positioning rim 23 arranged for engaging in the dihedrals 21 formed at the rear by the shanks 17 of the nails 16 of the strips 15 stacked on one another between the uprights 11 to 14 of the rack 5.

As described more clearly below, the strips of nails 15 are stacked in the storing rack 5 to form a stack 38, the strips lying one on another in planes that are substantially perpendicular to a so-called "feeding" plane in which each strip extends, after pivoting in the pivoting station 7 (FIGS. 3, 4) and in which it is pushed as far as the nose 2 of the tool.

With reference to FIGS. 2 to 7, the transport carriage 6 comprises a platform 24 mounted at is posterior end on a bent arm 25, and at its anterior end on a box 26 connected to the arm 25 by a connection rod 27. A jack 28 is secured to one of the two cross bars (9) of the storing rack 5 via its cylinder 29. The jack rod 30 is connected to the bent arm 25.

The jack 28 is actuated via an admission pipe 31 (FIG. 2).

When the jack 28 is actuated, e.g. from the posterior position of the carriage, i.e. in its position under the stack, or pile, 38 of strips of nails 15, and thus in its position for extracting the strip 15 being underneath the stack, the carriage 6 is driven to slide between the two cross bars 9, 10 of the rack 5.

Specifically for extracting the inferior strip from the stack of strips, the platform includes a table 32 for receiving said strip, which table is disposed at a level slightly lower than a thrust shoulder 33, by a height corresponding substantially to the thickness of one strip of nails. Given the crossed alternating disposition of the strips of nails, the shoulder 33 is shaped with a point pointing forwards so as to offer two shoulder portions 33, 35 extending parallel respectively to the shanks 17 of the nails that are inclined in opposite directions from one strip to the next.

In the rear position of the carriage 6, under the stored stack of strips 15, the inferior strip rests on the table 32. When the jack rod 30 is retracted into the cylinder 29, the carriage 6 is driven towards the pivoting station 7 of the magazine and the nose of the tool, taking with it, by means of the shoulder 33, the strip 15 that was resting on the table 32. As a result, the entire stack of strips of nails 15 moves down by one notch, i.e. through a height equal to the thickness of one strip, so as to rest on the two cross bars 9, of the rack 5 and on two reinforcing members 36, 37 fitted respectively thereto. In the opposite direction, when the jack 28 is actuated to reposition the carriage 6 under the stack of strips 38, the shoulder 33 and the superior table 39, which forms it with the inferior table 32 for receiving and extracting a strip, lift the stack 38 until it can move down again, after the shoulder 33 has gone past, and after a new strip of nails 15 has been received on the table 32.

It might happen that lifting the stack 38 for receiving and extracting a new strip of nails 15 is not so easy, because of the weight of the stack. For that reason, a separating pushing tablet 50 may be provided before the storing rack 5, slightly above the pivoting station 7 fixed onto the cross bars 9, 10, for separating the two inferior strips of nails stored in the rack 5. Such a separating pushing tablet has a rear bevelled end 51 shaped as a blade for carrying out the separating function. This tablet 50 is actuated by a rod 52 of a further pneumatic jack 53. To this end the tablet 50 comprises an upstanding bridge 54 receiving the free end 55 of the rod 52 comprising an annular groove 55 receiving the bridge 54.

While the carriage 6 is moving from the storing rack 5 to the pivoting station 7, the shank portion 17 of the nails 16 of the strip 15 disposed on the platform 32, adjacent to the heads 18, slide on the top edge 39, 40 of one of the two cross bars 9, 10 that pass through the pivoting station, the heads 18 on the outside, and the shanks 17 together with their points 19 on the inside.

Figure 5:
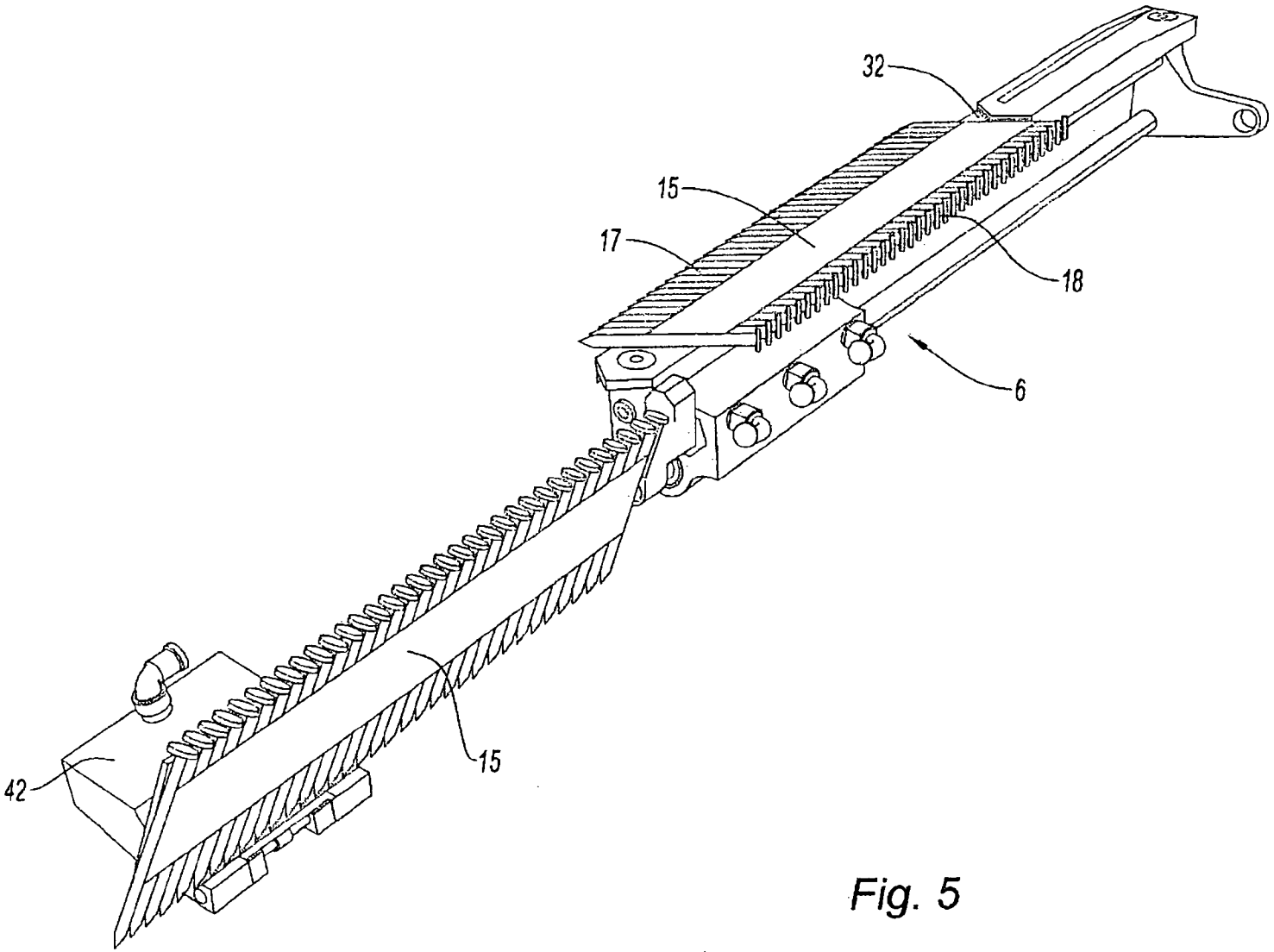
FIG. 5 is a perspective view of the transport means of the magazine of FIG. 2.
Figure 6:
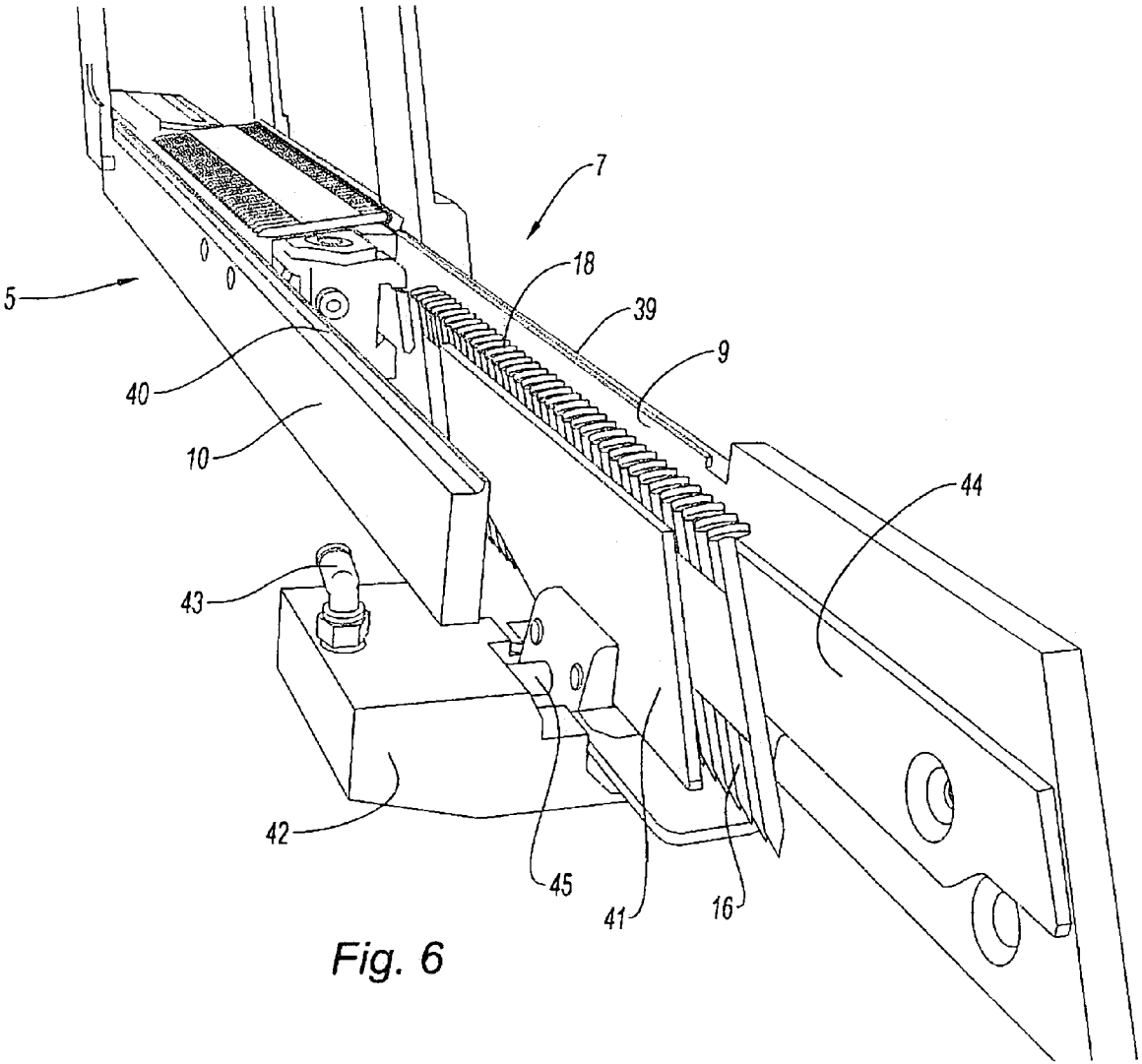
FIG. 6 is a perspective view of the magazine, with one nail strip on the platform of the transport means and one nail strip having pivoted and ready for being driven towards the outlet end the magazine.

In FIGS. 1 and 5, the nails of the strip 15 placed on the platform 32 have their heads 18 facing towards the observer and their shanks 17 have slid (FIG. 1) or will slide (FIG. 5) on the edge 39 of the cross bar 9. The nails of the following strip will slide on the edge 40 of the cross bar 10, opposite from the edge 39.

After the carriage 6 has driven the strip of nails 15 to the pivoting station 7, the carriage 6 moves rearwards, i.e. in the opposite direction, to return under the storing rack 5 and take hold of a new strip 15. Since the strip 15 is no longer supported by the carriage 6, it pivots and tilts under gravity about the shank portions that are adjacent to their heads 18, said strip being held by these heads on the edge of the cross bar.

Figure 3:
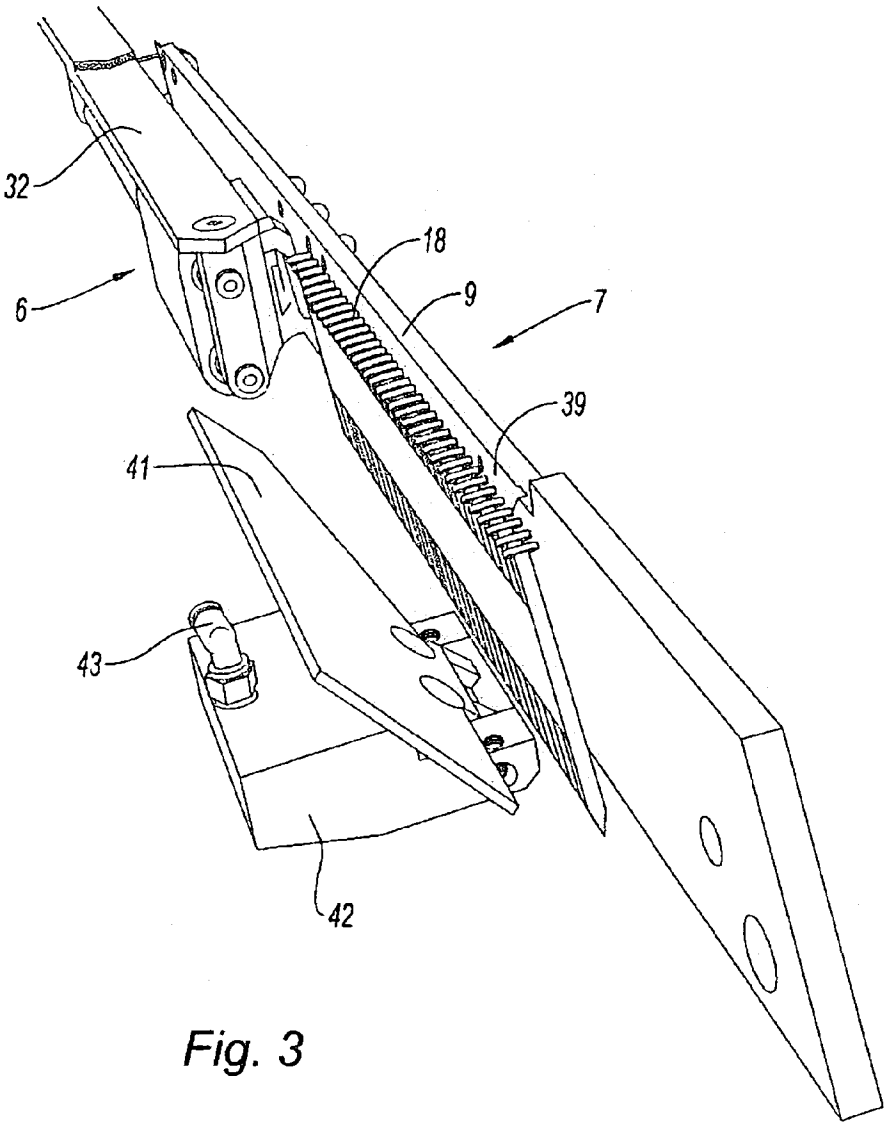
FIG. 3 is a perspective view of the pivoting station of the magazine of FIG. 2 illustrating the pivoting of a nail strip.
Figure 4:
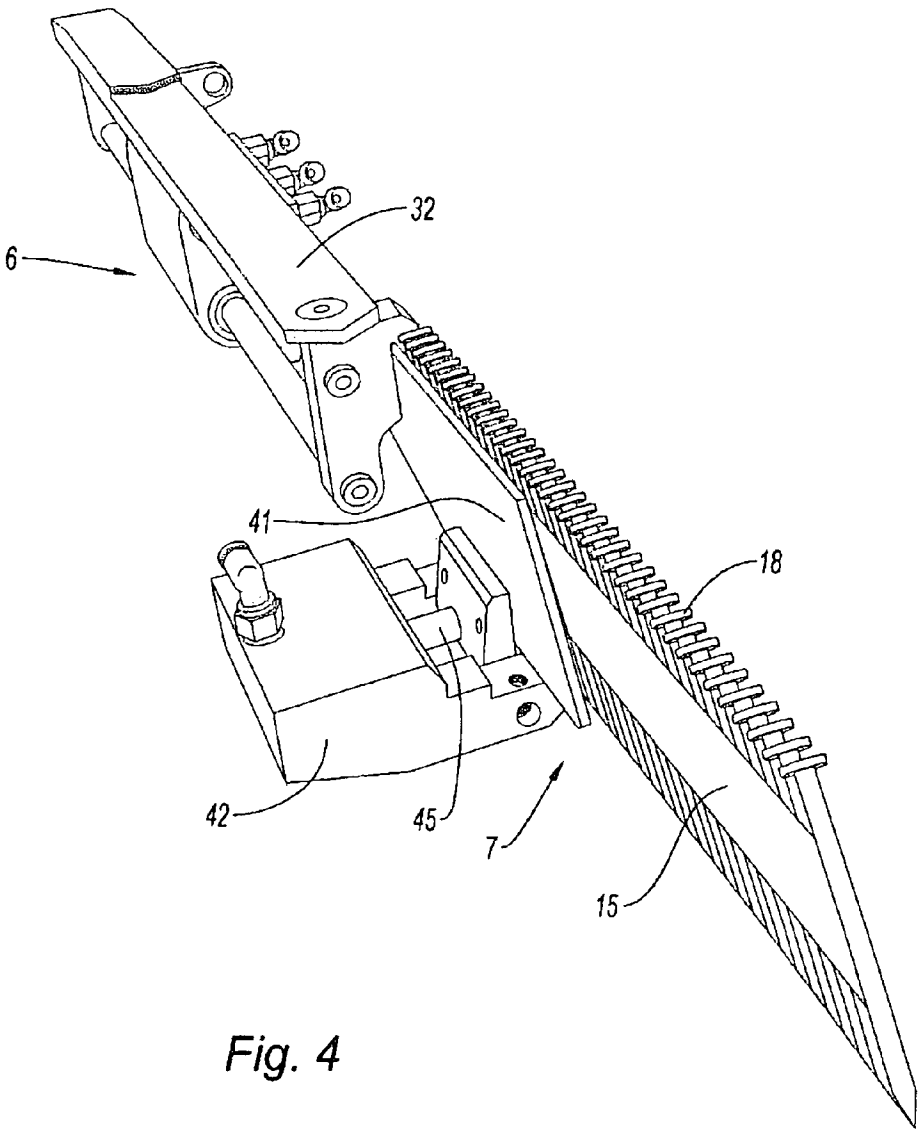
FIG. 4 is a perspective view of the pivoting station of FIG. 3, after pivoting the nail strip.

Before the nails tilt, a pivoting guiding plate 41 was located in an outwardly pivoted position, or open position (FIG. 3). While the strip of nails 15 is tilting, this mobile guiding plate 41 is pivoted inwards, into a closed, guiding position, by the rod 45 of a pneumatic jack 42, powered from a pipe 43, so as to go towards a second guiding plate 44 that is stationary (FIGS. 4 and G).

The nails 16 are then suspended by their heads 18 resting on the guiding plates 41, 44, with their shanks 17 extending between these guiding plates. The strip of nails 15 is then in a feeding plane for being pushed to the nose 2 of the tool. The nails are pushed forwards by the jack 28 until the forwards nail reaches an end position by hitting a contact valve which moves the rod of jack 28 backwards to pick another strip of fasteners from the magazine. Then, a small pushing jack 8 takes over temporarily for pushing the nails to the nose 2.

Figure 10:
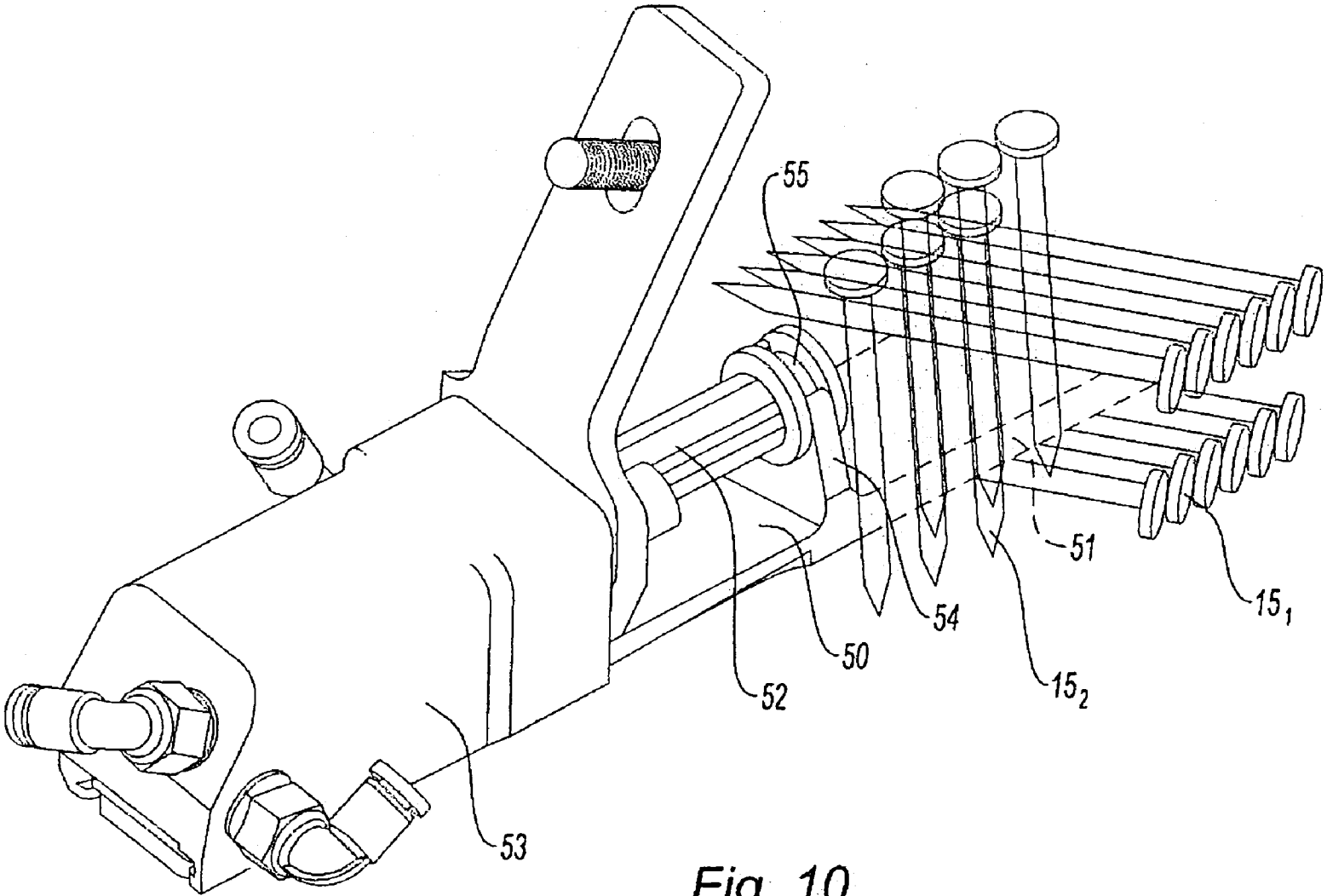
FIG. 10 is a perspective view of the separating pushing tablet illustrating its separating function.

In case the magazine comprises a separating pushing tablet 50, once a strip of nails at the pivoting station 7 is tilting prior to lying in the feeding plane, the tablet 50 is pushed backwards by rod 52 between the two inferior strips 15*i* and $\mathbf{15}_2$ (FIG. 10) in order to move up the stack of strips above the one 15*i* being underneath a little bit, by a small height and, thus, separate the heads of the two inferior strips. With a slight time delay, the carriage 6 is returned to its rear position, under the stored stack of strips in the storing rack 5. However, table 32 receives the inferior strip 15$\chi$ only. Jack 53 then moves tablet 50 in its forward position.

The invention claimed is:

1. A magazine for use with a nail-driving tool, said magazine comprising:

storing means for receiving and storing a plurality of nail strips in a side-by-side relationship relative to one another, each said nail strip being stacked in a storage plane and comprising a plurality of collated nails, and each nail having a head and a shank;

means for driving said nail strips along a feeding plane towards an outlet end of the magazine for feeding the tool with the nails in said nail strips, said feeding plane being substantially perpendicular to the storage plane of each said nail strip stacked in the storing means transport means for taking one nail strip out of said plurality of stored nail strips and moving said one nail strip towards the outlet end; and a pivoting station arranged for pivoting said one nail strip transported from the transport means into said feeding plane to be subsequently driven along said feeding plane by said driving means from said pivoting station towards said outlet end.

2. A magazine according to claim 1, wherein the pivoting station comprises an edge for retaining the heads of the nails of the nail strip to be pivoted, and two guiding walls for guiding the nails of the pivoted nail strip, one of the guiding walls being movable for enabling the nails to pivot under gravity about said edge.

3. A magazine according to claim 1, wherein said transport means comprise a movable platform arranged for extracting the one of the stacked nail strips lying underneath in the storing means.

4. A magazine according to claim 3, further comprising a jack for driving the platform.

5. A magazine according to claim 3, further comprising a pushing shoulder, wherein the platform comprises a reception plate at a level lower than the pushing shoulder by a height substantially equal to the thickness of a nail strip.

6. A magazine according to claim 5, wherein the pushing shoulder is shaped as a point for presenting shoulder portions parallel to the shanks of the nails of two successive nail strips, respectively.

7. A magazine according to claim 1, wherein the storing means include a rear vertical positioning rib for positioning the stacked nail strips when the nail strips are alternately in opposite directions, whereas the nails of each strip are inclined on the strip.

8. A magazine according to claim 7, wherein the pivoting station comprises two opposite edges for retaining the heads of the nails of two successive nail strips to be pivoted, respectively.

9. A magazine according to claim 1, further comprising a separating pushing tablet for separating two successive nail strips stored in the storing means.

10. A magazine according to claim 9, further comprising a jack having a rod for actuating the tablet.

11. A magazine for use with a nail-driving tool, said magazine comprising:

a storing device for receiving and stacking a plurality of nail strips in a plurality of parallel storage planes, respectively, each said nail strip comprising a plurality of collated nails, and each nail having a head and a shank;

a driving device for driving at least one said nail strip along a feeding plane towards an outlet end of the magazine for feeding the tool with the nails that supplies at least one nail strip, said feeding plane being non-parallel to the storage planes of said nail strip stacked in the storing device;

a transport device for taking one nail strip out of said plurality of stacked nail strips and moving said one nail strip towards the outlet end; and a pivoting station arranged for pivoting said one nail strip transported from the transport device into said feeding plane to be subsequently driven along said feeding plane by said driving device from said pivoting station towards said outlet end.

12. A magazine according to claim 11, wherein the pivoting station comprises an edge for retaining the heads of the nails of the nail strip to be pivoted, and two guiding walls for guiding the nails of the pivoted nail strip, one of the guiding walls being movable for enabling the nails to pivot under gravity about said edge.

13. A magazine according to claim 11, wherein said transport device comprises a movable platform arranged for extracting the one of the stacked nail strips lying underneath in the storing device.

14. A magazine according to claim 13, further comprising a pushing shoulder, wherein the platform comprises a reception plate at a level lower than the pushing shoulder by a height substantially equal to the thickness of a nail strip.

15. A magazine according to claim 14, wherein the pushing shoulder is shaped as a point for presenting shoulder portions parallel to the shanks of the nails of two successive nail strips, respectively.

16. A magazine according to claim 11, further comprising said nail strips, wherein the nails in adjacent said nail strips are oriented in opposite directions.

17. A magazine according to claim 16, wherein the nails of each said nail strip are inclined on the strip.

18. A magazine according to claim 17, wherein the pivoting station comprises two opposite edges for retaining the heads of the nails of two successive nail strips to be pivoted, respectively.

19. A magazine according to claim 11, further comprising:

a separating pushing tablet for separating two successive nail strips stored in the storing device.

20. A magazine according to claim 11, wherein the feeding plane is perpendicular to the storage planes.

* * * * *